US007850427B2

(12) United States Patent
Peer et al.

(10) Patent No.: US 7,850,427 B2
(45) Date of Patent: Dec. 14, 2010

(54) CLOSURE DEVICE FOR A TURBOMACHINE CASING

(75) Inventors: David James Peer, Olean, NY (US); Lingzhi Wang, York, PA (US)

(73) Assignee: Dresser-Rand Company, Olean, NY (US)

( * ) Notice: Subject to any disclaimer, the term of this patent is extended or adjusted under 35 U.S.C. 154(b) by 928 days.

(21) Appl. No.: 11/653,630

(22) Filed: Jan. 16, 2007
(Under 37 CFR 1.47)

(65) Prior Publication Data

US 2008/0031732 A1 Feb. 7, 2008

Related U.S. Application Data

(63) Continuation-in-part of application No. 11/605,185, filed on Nov. 28, 2006, now abandoned.

(60) Provisional application No. 60/740,759, filed on Nov. 30, 2005.

(51) Int. Cl.
*F01D 25/24* (2006.01)

(52) U.S. Cl. ..... 415/214.1; 415/220; 415/230

(58) Field of Classification Search ..... 415/215.1, 415/214.1, 220, 134, 135, 229, 230
See application file for complete search history.

(56) References Cited

U.S. PATENT DOCUMENTS 3,478,955 A * 11/1969 Kunderman ..... 417/507
3,664,001 A * 5/1972 Pilarczyk ..... 29/888.21
3,874,814 A 4/1975 Carroll et al.
3,963,371 A * 6/1976 Sieghartner ..... 415/55.6
4,005,515 A 2/1977 Sundt
4,218,181 A 8/1980 Komatsu et al.
4,380,405 A 4/1983 Kaneki et al.
4,397,609 A 8/1983 Kochendorfer
4,479,756 A * 10/1984 Sieghartner ..... 415/55.6
4,532,955 A 8/1985 Squires
4,646,810 A 3/1987 Lardellier
5,464,226 A 11/1995 Dalton
5,715,596 A 2/1998 Bintz
6,336,641 B1 1/2002 Williams
2004/0036229 A1 2/2004 Takahashi et al.

OTHER PUBLICATIONS

Cohen, P. et al. The ASME handbook on water technology for thermal power systems. New York: The American Society of Mechanical Engineers, 1989, ISBN 0791803007, Fir. 3-26 on p. 143.

* cited by examiner

*Primary Examiner*—Ninh H Nguyen
(74) *Attorney, Agent, or Firm*—Edmonds & Nolte, PC

(57) ABSTRACT

A high pressure turbomachine includes a casing having an interior chamber, an opening into the interior chamber, and a generally annular wall section extending about the opening and having an outer circumferential surface. A closure device is engageable with the casing and includes a body having an inner circumferential overlap surface defining an opening. The closure body is configured to receive at least a portion of the casing annular wall section within the body opening such that the closure body overlap surface extends about the annular wall section outer surface so that the body substantially closes the casing opening. When the casing chamber contains high pressure fluid, the casing wall section expands radially outwardly such that the casing section outer surface pushes generally radially outwardly against the closure body overlap surface, the closure body being configured to either minimize or substantially prevent casing wall radial expansion.

15 Claims, 12 Drawing Sheets

CLOSURE DEVICE FOR A TURBOMACHINE CASING

This application is a continuation-in-part of U.S. patent application Ser. No. 11/605,185, filed Nov. 28, 2006 now abandoned, which claims priority to U.S. Provisional Application Ser. No. 60/740,759, filed Nov. 30, 2005, the entire contents of which are incorporated herein by reference.

The present invention relates to fluid machinery, and more specifically to casing components for a turbomachine.

Referring to FIG. 1, turbomachines M such as centrifugal compressors generally include compressor components (e.g., impellers) mounted on a central shaft S and disposed within a casing C. The shaft S typically extends through an opening $O_C$ at one, and often both, ends $E_{C1}$, $E_{C2}$ of the casing C. As such, a device for closing the casing opening $O_C$ about a shaft portion $S_P$ therewithin is required. Typically, at least one end closure CL is provided which consists of a plug-like body disposed within the casing opening $O_C$, which is axially retained therein by a plurality of shear keys KS which extend between the closure body outer surface $CL_{OS}$ and the casing inner surface $C_{IS}$.

SUMMARY OF THE INVENTION

In one aspect, the present invention is a turbomachine comprising a casing having an interior chamber, an opening into the interior chamber, and a generally annular wall section extending about the opening and having an outer circumferential surface. A closure device is engageable with the casing and includes a body having an inner circumferential overlap surface defining an opening. The closure body is configured to receive at least a portion of the casing annular wall section within the body opening such that the closure body overlap surface extends about the annular wall section outer surface and the closure body substantially closes the casing opening.

In another aspect, the present invention is a turbomachine comprising a casing having an interior chamber, an opening into the interior chamber, and a generally annular wall section extending generally about the opening and having an outer circumferential surface. A closure device is engageable with the casing and includes a generally circular cylindrical body with a central axis and an integral annular ledge extending circumferentially about the axis, the body ledge having an inner circumferential overlap surface at least partially defining an opening. The closure body is configured to receive at least a portion of the casing annular wall section within the body opening such that the closure body overlap surface extends about the annular wall section outer surface and the closure device substantially closes the casing opening.

In a further aspect, the present invention is a closure device for a high pressure turbomachine, the turbomachine including a casing having an interior chamber configured to contain high pressure fluid and a generally annular wall section defining an opening into the interior chamber and having an outer circumferential surface. The closure device comprises a generally cylindrical body engageable with the casing and having an inner circumferential overlap surface defining an opening. The closure body is configured to receive at least a portion of the casing annular wall section within the body opening such that the closure body overlap surface extends about the annular wall section outer surface to substantially close the casing opening.

In yet another aspect, the present invention is a high-pressure fluid machine comprising a casing having an interior chamber, an opening into the interior chamber, and a generally annular wall section extending generally about the opening and having an outer circumferential surface. A closure device is engageable with the casing and includes a body having an inner circumferential overlap surface at least partially defining an opening. The closure body is configured to receive at least a portion of the casing annular wall section within the body opening such that the closure body overlap surface extends about the annular wall section outer surface and the closure device substantially closes the casing opening.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
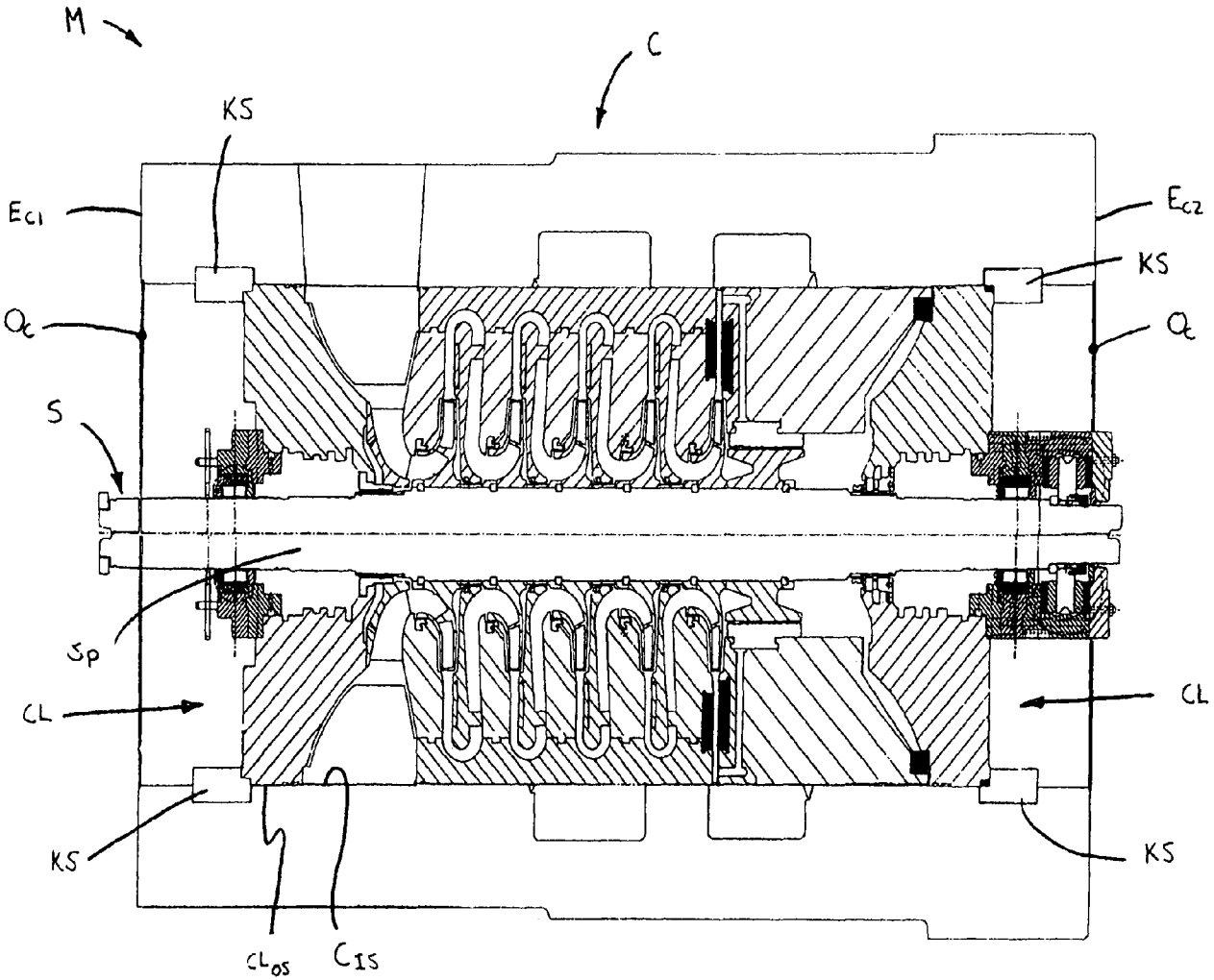
FIG. 1 is an axial cross-sectional view of a turbomachine having two prior art closure devices.

Certain terminology is used in the following description for convenience only and is not limiting. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Referring now to the drawings in detail, wherein like numbers are used to indicate like elements throughout, there is shown in FIGS. 2-18 a closure device 10 for a fluid machine, preferably a turbomachine 1 and most preferably a high-pressure compressor 2, as described below. The turbomachine 1 comprises a casing 3 having opposing axial ends 3*a*, 3*b*, a central axis 4 extending between the two ends 3*a*, 3*b*, a central bore $B_C$ providing an interior "working" chamber $C_C$ for containing the working components of the machine 1, and an opening $O_C$ (FIGS. 2 and 10) into the interior chamber $C_C$. The casing 3 also has a generally annular wall section 5 extending generally circumferentially about the opening $O_C$, the wall section 5 having an outer circumferential surface 6 and an opposing inner circumferential surface 7. A rotatable shaft 8 is disposed within the casing chamber $C_C$ so as to extend generally along (and be rotatable about) the axis 4 and has a portion 8*a* disposed within, or extending through, the casing opening $O_C$. Basically, the closure device 10 is engageable with the casing 3 and includes a generally cylindrical body 12 with a centerline 13 and having an inner circumferential overlap surface 14 at least partially defining an opening $O_B$. The closure body 12 is configured to receive at least a portion of the casing annular wall section 5 within the body opening $O_B$, such that the closure body overlap surface 14 extends about the annular wall section outer surface 6 and the closure device 10 substantially closes, and preferably seals, the casing opening $O_C$.

Preferably, the closure body 12 also has a central through hole $H_T$ sized to receive the portion 8*a* of the shaft 8 disposed within or extending through the casing opening $O_C$, as described above and in greater detail below, although the closure device 10 may alternatively be formed without any such through hole and used to close other types of casing openings (i.e., other than an opening surrounding the shaft 8). In any case, the closure device 10 of the present invention is configured or constructed to substantially obstruct or seal the casing opening $O_C$ so as to at least substantially prevent high pressure fluid from flowing out of the chamber $C_C$ through the opening $O_C$. For such a preferred application, the closure body 12 preferably has a substantial axial thickness $T_A$ such that the closure device 10 is capable of resisting relatively high pressure without a substantial deformation or failure of the device 10.

Referring to FIGS. 2-9, a first preferred embodiment of the closure device 10 is sized or configured to be disposed or received/fitted within a portion of the fluid machine casing 3, particularly such that the closure device body 12 is disposeable within a portion of the casing bore $B_C$ so as to be entirely located between the first and second casing ends 3*a*, 3*b*. In other words, the closure device body 12 has first and second axial ends 12*a*, 12*b* and when installed in the casing 3, the body first end 22*a* is spaced axially from the casing first end 3*a* in a direction toward the casing second end 3*b* and the body second end 12*b* being spaced axially from the casing second end 3*b* in a direction generally toward the casing first end 3*a*. Preferably, the first embodiment closure device 10 is constructed for use with a casing 3 having a stepped inner bore 16 defined by a first, radially-smaller inner circumferential surface 17 with a first diameter $d_1$ and at least one second, radially-larger inner circumferential surface 18 with a second diameter $d_2$, the second diameter $d_2$ being substantially larger than the first diameter $d_1$. A generally annular shoulder surface 19 extends generally radially between the bore first and second inner circumferential surface sections 17, 18 and generally circumferentially about the casing axis 4. Further, a generally annular lip or ledge 20 extends generally axially from the radial shoulder surface 19 and circumferentially about the casing axis 4 and provides the casing annular wall section 5 and outer circumferential surface 6, as described above. As such, a generally annular gap 21 is defined between the annular wall section outer surface 6 and the radially-larger bore surface section 18.

With such a casing structure, the body 12 of the first embodiment closure device 10 is preferably formed as a substantially circular, cylindrical body 22 with an integral annular ledge 24 engageable about the casing annular ledge 20. Specifically, the cylindrical body 22 is substantially symmetrical about the centerline 13 and has opposing first and second axial ends 22*a*, 22*b*. The annular ledge 24 extends circumferentially about the centerline 13 and having an inner circumferential surface providing the overlap surface 14. Preferably, the cylindrical body 22 has a generally circular cavity or pocket 23 extending axially from the first end 22*a* toward the second end 22*b* and defining the body opening $O_B$ and the annular ledge/wall section 24. Thus, the overlap surface 14 partially defines or bounding the circular pocket 23. Preferably, the closure body 22 further has a generally circular, integral hub portion 25 disposed within the pocket 23 and extending axially toward the body first end 22*a*. The body hub portion 25 has an outer circumferential surface 25*a* spaced radially inwardly from the overlap surface 14 so as to define an annular space AB sized to receive the casing annular wall section 5, specifically the preferred casing annular ledge 20.

With the preferred structures of the casing 3 and the closure body 12, the closure body annular wall section 24 is disposed within the casing annular gap 21 and the casing annular ledge 20 is disposed in the closure body pocket 23, specifically within the annular space $A_B$, when the closure device 10 is engaged with the casing 3. Preferably, the closure body 22 has an outer circumferential surface 26 extending axially between the ends 22*a*, 22*b* and spaced radially outwardly from the overlap surface 14, and an end surface 27 extending generally radially between the overlap surface 14 and the outer circumferential surface 26. As such, when the closure device 10 is engaged with the casing 3, the closure device radial end surface 27 is disposed generally against the casing shoulder surface 19 and the casing bore radially-larger inner circumferential surface 18 is disposed circumferentially about the closure device outer circumferential surface 26.

Figure 2:
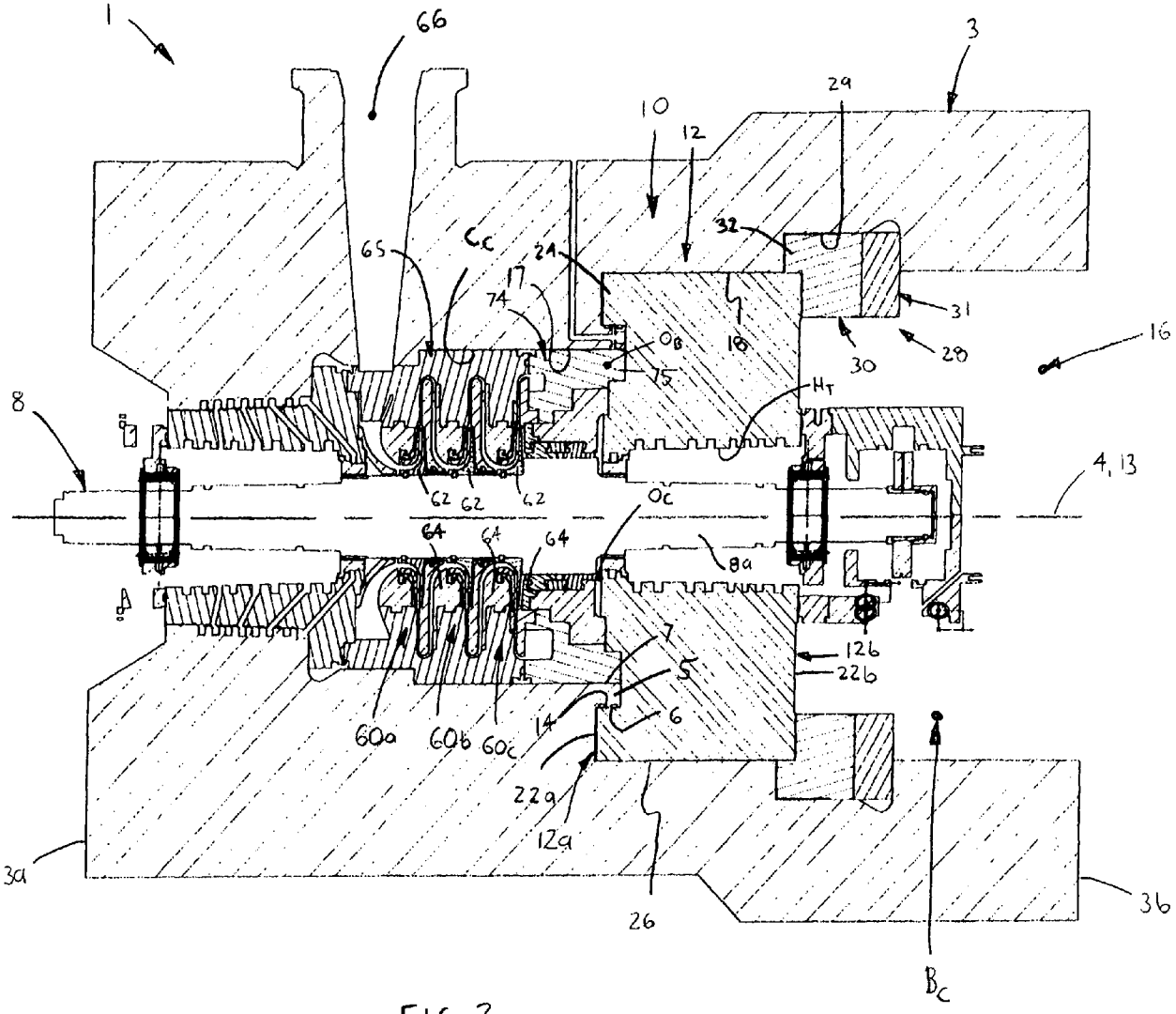
FIG. 2 is an axial cross-sectional view of a turbomachine having one closure device in accordance with a second embodiment of the present invention.
Figure 3:
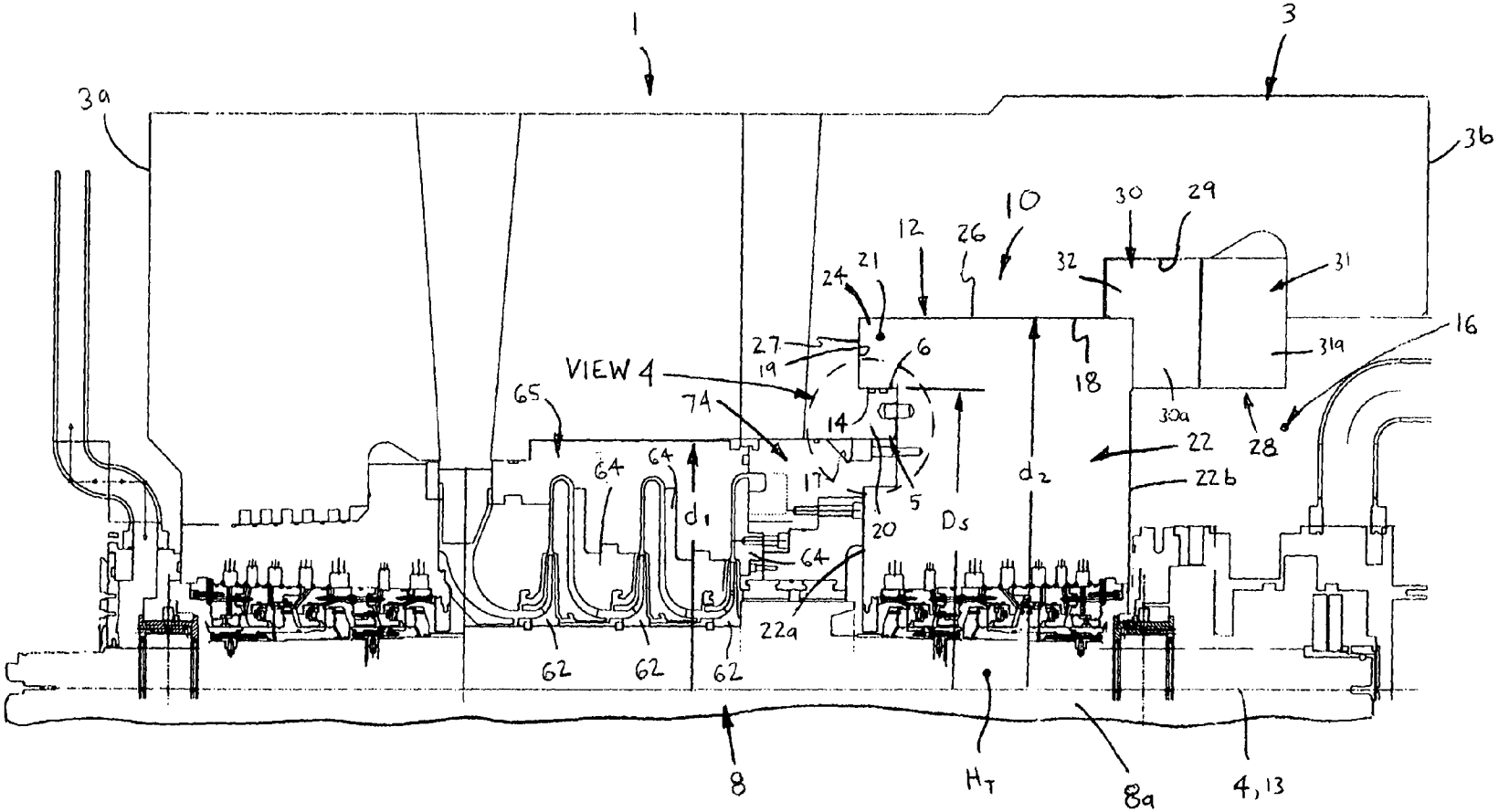
FIG. 3 is an enlarged axial cross-sectional view of an upper half of the turbomachine of FIG. 2.

Referring to FIGS. 2 and 3, the first embodiment closure device 10 preferably further includes at least one retainer 28 engageable with the casing 3 and configured to retain the closure body 12 coupled with the casing 3, and more specifically configured to prevent displacement of the closure body 12 relative to the casing 3 in a direction generally along the casing axis 4. Preferably, the casing 3 further has a generally annular groove 29 extending radially outwardly from the casing inner circumferential surface section 18 and circumferentially about the central axis 4, and the retainer 28 is disposeable within the groove 29 and against the closure device second axial end 22*b*. As such, the preferred closure body 22 is disposed and retained generally between the retainer 28 and the casing annular ledge 20 or/and radial shoulder surface 19. Most preferably, the retainer 28 includes two rings 30, 31, the first or "sheer" ring 30 having an axial lip 32 disposed or disposeable between a portion of the closure body 12 and the casing groove 29. Each ring 30, 31 is preferably formed of a plurality of arcuate segments 30*a*, 31*a* (only one each shown), spaced circumferentially about the casing axis 4. Furthermore, the closure device 10 preferably also includes another retainer (not shown) configured to at least prevent rotational displacement of the closure body 12 about the casing central axis 4. The other or second retainer is preferably provided by at least one dowel (not shown) extending between aligned openings (not shown) in the casing annular wall section 5 and the closure body 12.

In a second embodiment shown in FIGS. 10-18, the closure device 10 is configured to engage with an outer axial end 3*a* or 3*b* of the casing 3. Preferably, the closure body 12 of the second embodiment device is preferably formed a complex-shaped body 33 including a generally cylindrical inner portion 34 and a generally annular outer portion 36. The annular outer portion 36 is integrally connected with and spaced radially outwardly from the inner portion 34 so as to define a generally annular opening $A_B$. The cylindrical inner portion 34 is at least partially disposeable within the casing opening $O_C$ and has an outer circumferential surface 35. The annular outer portion 36 provides the overlap surface 14, as discussed above. Further, the annular opening $A_B$ is one preferred form of the body opening $O_B$, such that the body 12 is configured to receive at least a portion of the casing annular wall section 5 within the annular opening $A_B$. Thus, the casing annular wall section 5 is preferably disposed or "sandwiched" generally between the body outer annular portion 36 and the body inner cylindrical portion 34, with the overlap surface 14 extending about the casing annular wall section outer surface 6 and the casing wall inner surface 7 extending about the body inner portion outer surface 35.

Figure 15:
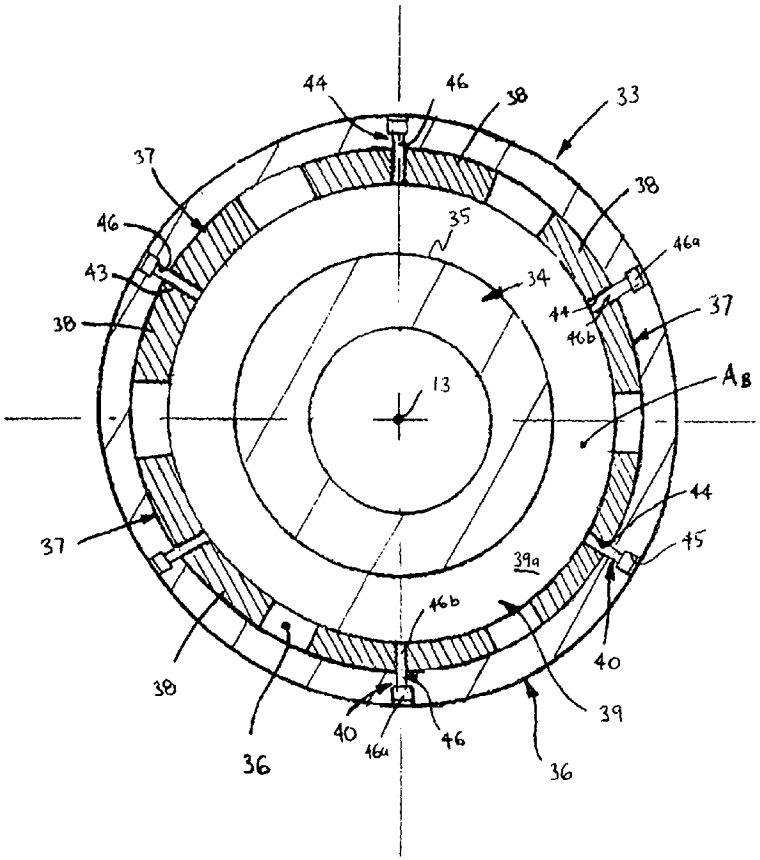
FIG. 15 is a radial cross-sectional view of the closure device.

Referring to FIGS. 10, 15, 16 and 18, the second embodiment of the closure device 10 preferably further comprises at least one and preferably a plurality of retainers 37 or "shear keys" engageable with the casing 3 and configured to retain the closure body 12 coupled with the casing 3. More specifically, the retainer(s) 37 substantially prevent displacement of the closure body 12 relative to the casing 3 in a direction generally along the casing axis 4, and also preferably prevent rotational displacement of the body 12 about the axis 4. Preferably, the casing annular wall section 5 and the closure body 12 have facing circumferential grooves 40, 42, respectively, the one or more retainers 37 being disposeable simultaneously within both grooves 40, 42 to thereby at least prevent axial movement of the closure body 12 with respect to the casing 3. More specifically, the casing 3 has a generally circumferential groove 40 extending radially inwardly from the annular wall section outer circumferential surface 6 and circumferentially about the casing axis 4, and the closure body 12 has an circumferential groove 42 extending generally radially outwardly from the inner circumferential surface 24, and circumferentially about the body centerline 13. With this structure, the plurality of the retainers 37 are spaced circumferentially within the closure body groove 42, and are disposeable within a separate, circumferentially spaced apart section of the casing groove 40. Preferably, each retainer 37 includes a generally arcuate body 38, as best shown in FIG. 15, having an outer circumferential portion 38*a* disposed within the closure body groove 42 and an inner circumferential portion 38*a* disposeable within the casing annular groove 40, such that the retainer(s) 37 "key" the closure body 12 onto the casing 3, as discussed in greater detail below.

Figure 16:
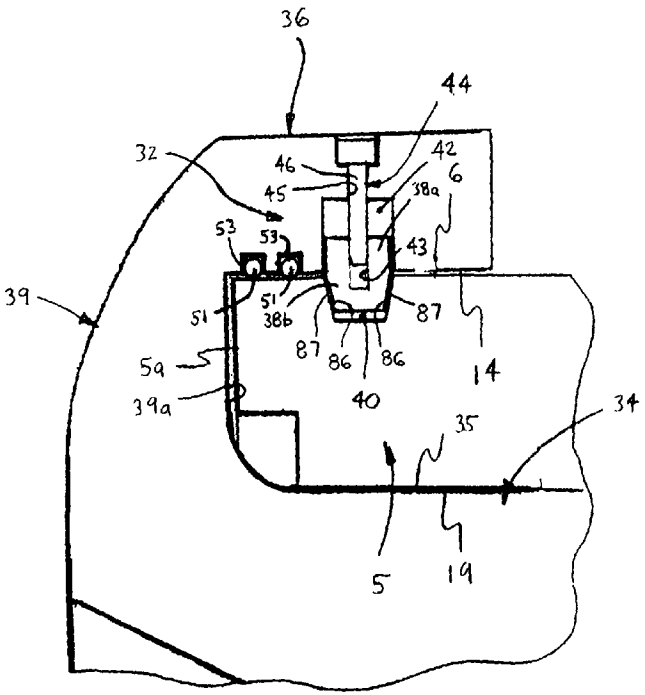
FIG. 16 is an enlarged broken-away portion of the axial cross-sectional view of FIG. 10, showing an alternative retainer structure.

Referring to FIGS. 15 and 16, the second embodiment closure device 10 also preferably includes at least one and preferably a plurality of positioners 44 each configured to displace a separate one of the retainer bodies 38 radially with respect to the closure body 12. That is, each positioner 44 advances the retainer body 38 into the casing groove 40 and alternatively withdraws the retainer body 38 from the casing groove 40. Preferably, the closure body 12 includes a separate counterbore hole 45 for each positioner 44 and each retainer 37 includes at least one threaded opening 43. Further, each positioner 44 preferably includes a threaded rod 46, most preferably a cap screw, having a first end 46*a* disposed within the closure device counterbore hole 42 and second end 46*b* threadably engaged with the retainer opening 43. As such, rotation of each rod 46 in a first direction advances the coupled retainer body 38 into the casing groove 40 and rotation of the rod 46 in a second, opposing direction withdraws the body 38 from the groove 40.

As depicted in FIGS. 2-4, 10, 16 and 18, the closure device 10 preferably additionally comprises at least one and preferably two generally annular seal members 50 configured to substantially prevent fluid flow out of the casing chamber $C_C$. Each seal member 50 is preferably disposed about the casing annular wall section 5 and is configured to seal outwardly against the closure body overlap surface 14. Preferably, the annular wall section 5 of the casing 3 includes at least one and preferably two circumferential seal grooves 52 each extending radially inwardly from the outer circumferential surface 6 and spaced axially apart. Further, the seal member(s) 50 are preferably each a compressible ring (e.g., a polymeric ring) disposed at least partially within one casing wall seal groove 52 and disposeable against the closure body overlap surface 14 so as to seal the gap or space between the closure body 12 and the casing annular wall section 5. Preferably, the one or more seal grooves 52, and thus the seal members 50, are each disposed axially between the wall section radial end surface 16*a* and the casing retainer groove 40.

In an alternative construction of the second embodiment depicted in FIG. 16, each seal member 50 extends at least partially into the body opening $O_B$ and is configured to seal inwardly against the casing wall outer surface 6 to substantially prevent fluid flow out of the casing chamber $C_C$. As such, the closure body 12 includes at least one and preferably two circumferential seal grooves 53 each extending radially outwardly from the inner circumferential overlap surface 14 into the body annular portion 36, the two grooves 53 being spaced axially apart from each other. Further, the one or more seal members 50 are each a compressible ring disposed at least partially within one closure body seal groove 53 and disposeable about the casing outer surface 6 when the closure body 12 is installed upon the casing wall section 5, so as to seal the space between the body 12 and the wall section 5. Preferably, the seal groove(s) 53 are located on the closure body 12 so as to be spaced axially inwardly from the retainer groove 42, so as to be located axially between the radial end surface 16*a* of the casing wall annular section 16 and the retainer(s) 37 when the closure device 10 is engaged with the casing 3.

Although not preferred, either of the first and second embodiments of the closure device 10 may be formed with one or more seal members disposed in each one of the casing 3 and the closure body 12, or constructed without any seal members (neither structure shown).

With the above structure, both embodiments of the closure device 10 of the present invention are clearly advantageous compared with previously known fluid machine casing closure devices. In the preferred application, the closure device 10 is used to seal the working chamber $C_C$ of a high-pressure compressor 2, as mentioned above and described in further detail below. During operation of such compressors, the casing chamber $C_C$ will contain high-pressure fluid, which often exerts a pressure on the casing 3 sufficient to cause the entire casing 3, including the annular wall section(s) 5, to expand radially outwardly, as indicated by arrow $E_R$ in FIG. 4. As such, the casing section outer surface 6 pushes generally radially outwardly against the closure body overlap surface 14. The closure body 12, extending circumferentially about and encasing the casing annular wall section 5, is configured to minimize or to substantially prevent casing wall radial expansion. Further, any slight expansion of the casing annular wall section 5 substantially eliminates any space between the closure body overlap surface 14 and the annular wall section outer surface 6, thus acting to prevent leakage of fluid from the casing chamber $C_C$.

Furthermore, due to the body 12 of either construction being engaged by the retainers 28 or 37 generally proximal to the body outer perimeter, high pressure fluid tends to deflect central portions of the body 12 outwardly to certain extent while the outer circumferential portions are relatively axially fixed. Such outward deflection of the body central portion causes the body annular ledge/portion 24, 36 of the first and second embodiments, respectively, to bend or deflect generally radially inwardly toward the central axis 13 as indicated by arrow $B_1$ in FIG. 4. The radial inward bending/deflection of the ledge 24 or annular portion 36 also serves to eliminate any space between the closure body overlap surface 14 and the casing outer surface 6. Previously known "plug" type closure devices 5 (FIG. 1) cannot constrain the casing 3 against radial expansion, and bending of the outer perimeter of such plug devices would tend to increase separation from the casing inner surface, such that some fluid leakage about the closure device 5 typically occurred at higher internal pressures.

Additionally, by having a body 22 that is diametrically or radially smaller than the body 33 of the second embodiment and is configured to be received within a portion of the casing 3, the first, preferred embodiment of the sealing device 10 has a sealing diameter $D_S$ (see FIGS. 3 and 4) between the casing 3 and the closure device 10 that is substantially reduced as compared with the sealing diameter (not indicated) of the second embodiment body 33. The smaller or lesser sealing diameter $D_S$ substantially reduces the overall stress, end load, deflection, and material requirements of the first embodiment closure device 10 as compared to the second embodiment device 10.

Having described the basic elements above, these and other components of the closure device 10 of the present invention are described in detail below.

Referring to FIGS. 2, 3, 10, 17 and 18, the closure device 10 of the present invention is preferably used with a centrifugal compressor 2 that includes at least one and preferably a plurality of stages 60 (e.g., stages 60*a*-60*c*), each stage 60 including a rotatable impeller 62 mounted to the shaft 8 and at least one stationary diaphragm 64 providing outlet and inlet flow passages between each impeller 60. Alternatively, the closure device 10 may be used with any other type of turbomachine, particularly high-pressure machines, such as for example, a centrifugal pump, a rotating/rotary separator, another type of pump, a motor, etc. Further, the preferred compressor 2 preferably further includes an inner, generally tubular casing 65 disposed within the main casing chamber $C_C$ and about the shaft 8, the inner casing 65 being configured to secure the diaphragms 64 within the compressor 2. Also, the outer casing 3 further includes a fluid inlet 66 connected with a fluid inlet chamber 68 disposed adjacent to the first compressor stage 60*a* and an outlet chamber or volute (not shown) fluidly connected with the last compressor stage.

Figure 7:
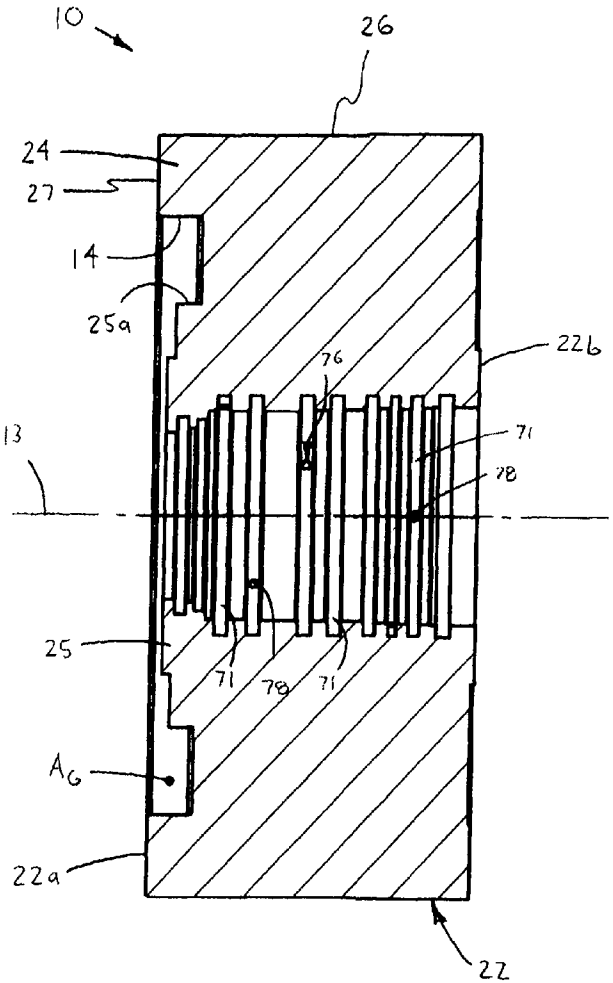
FIG. 7 is an axial cross-sectional view of the closure device of FIG. 6.
Figure 10:
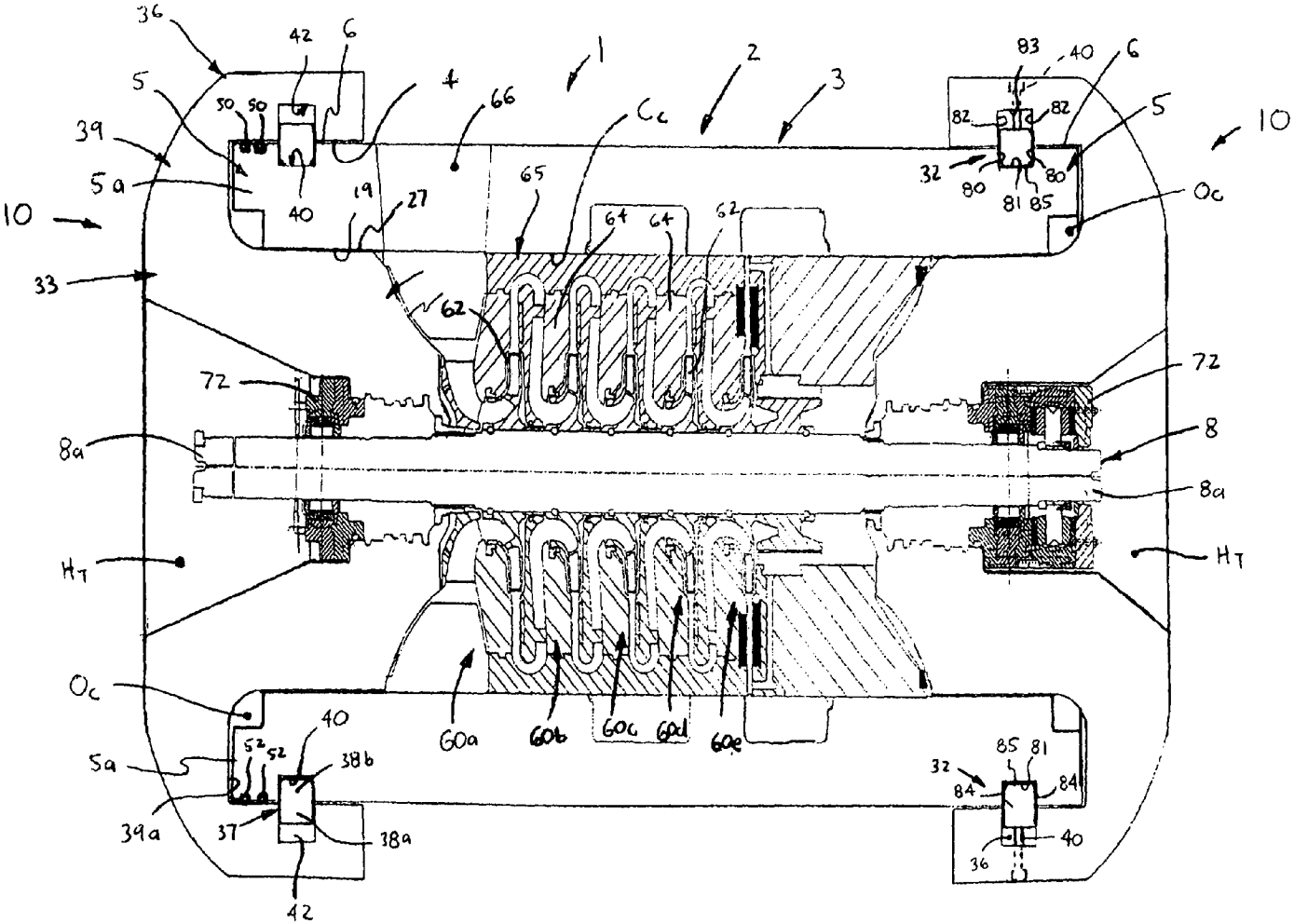
FIG. 10 is an axial cross-sectional view of a turbomachine having two closure devices in accordance with a second embodiment of the present invention.
Figure 18:
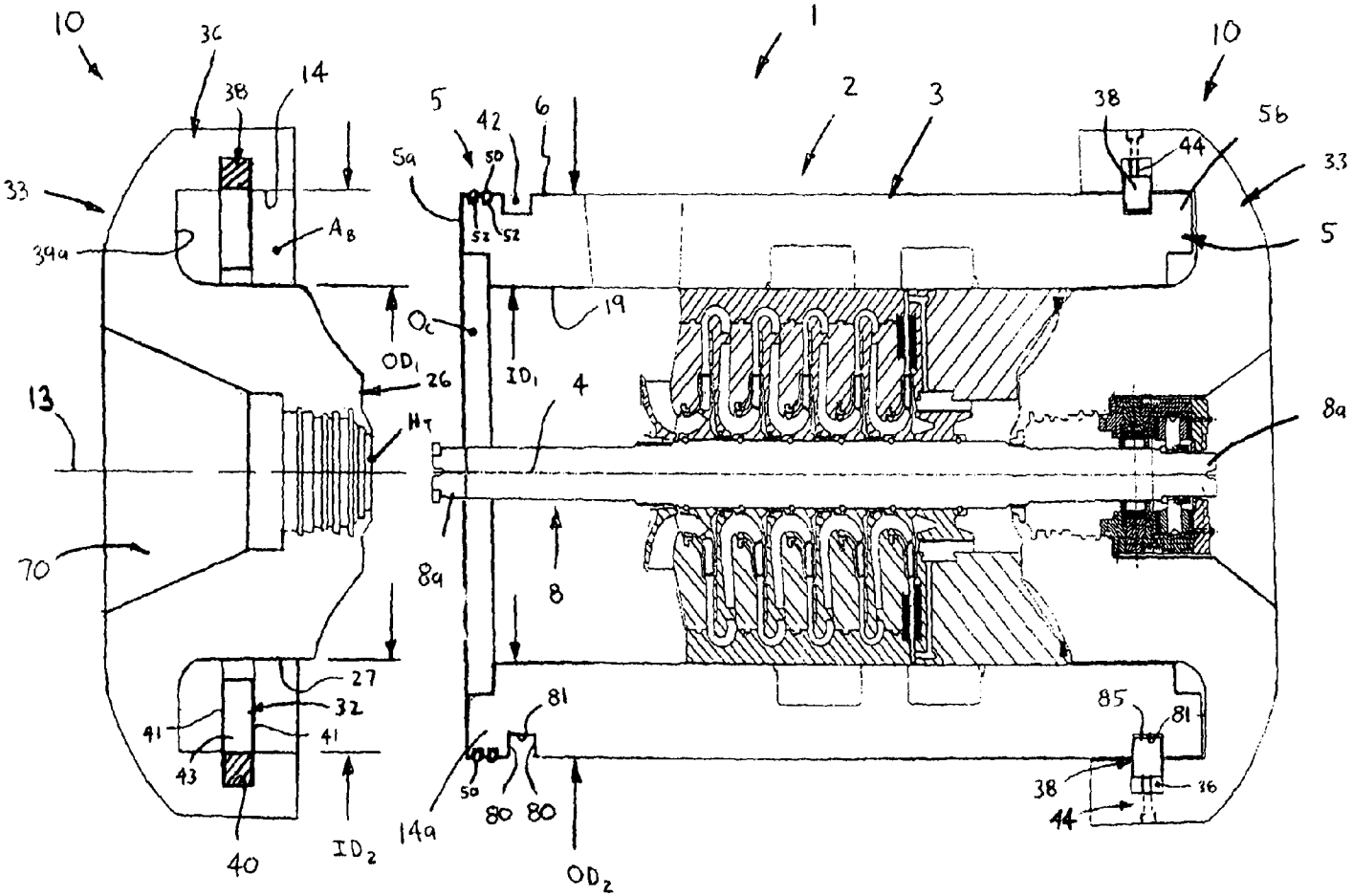
FIG. 18 is another view of the turbomachine of FIG. 10, showing one second embodiment closure device spaced from the casing.

Referring now to FIGS. 2, 3, 7, 10, 12 and 18, when the closure device 10 of the present invention is used to support a shaft portion 8*a* as preferred, the closure body 12 further has another or second, radially smaller inner circumferential surface 70 at least partially defining the through hole HT. In the first, preferred embodiment, a plurality of annular grooves 71 extend radially outwardly from the inner circumferential surface and are configured to receive and/or support portions or components of a sealing assembly (not shown) for sealing about the shaft 8, as depicted in FIGS. 2, 3 and 7. In the second embodiment as shown in FIGS. 10 and 18, the through hole inner circumferential surface 70 includes a first, seal portion 70*a* with grooves 31 and configured to support the seal assembly (not shown), a second, bearing portion 70*b* configured to support a bearing 72 for rotatably supporting the shaft 8, and a third, preferably conical-shaped clearance portion 70*c* enlarged to provide access to the shaft 8, the bearing 72 and the seal assembly.

Figure 5:
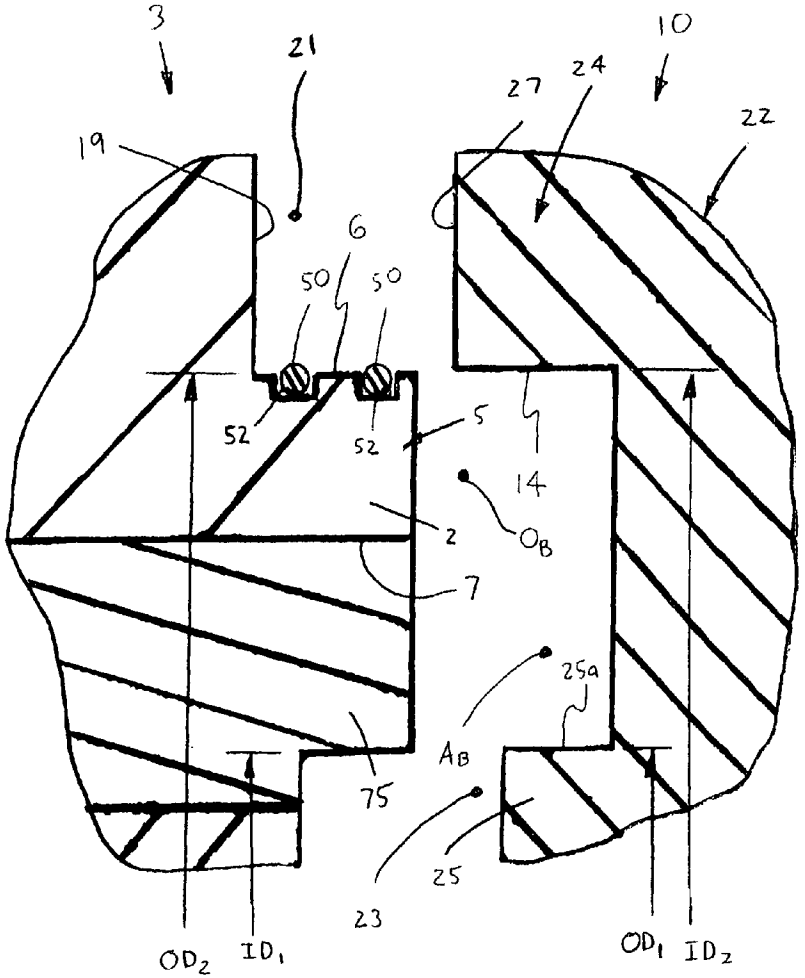
FIG. 5 is another view of FIG. 4, shown with a closure device body spaced axially from a casing wall section.

Referring to FIGS. 2-5, the first embodiment closure device is preferably used with a compressor assembly that further includes a tubular spacer member 74 disposed axially between the last compressor stage 60 and the compressor chamber opening $C_C$. The spacer member 74 includes a generally annular ledge 75 disposed coaxially within the casing annular ledge 20, and the annular space $A_B$ of the preferred cylinder body 22 simultaneously receives at least a portion of both the casing ledge 22 and the spacer ledge 75. Preferably, the outer circumferential surface 25*a* of the cylinder body hub portion 25 is preferably sized to cylindrical portion 34 is preferably sized to fit relatively "closely" within and against an inner circumferential surface 75*a* of the spacer ledge 75 so as to substantially eliminate clearance space between the body hub 25 and the spacer member 74. That is, the spacer member inner surface 75*a* preferably has an inside diameter $ID_1$ that is slightly greater than the closure body hub surface outside diameter $OD_1$, as indicated in FIG. 5. Furthermore the closure body annular portion 24 is sized to fit closely about the casing annular wall portion 5 with minimal clearance; in other words, the closure body overlap surface 14 has an inside diameter $ID_2$ that is only slightly greater than outside diameter $OD_2$ of the casing wall outer surface 6. Thus, the closure body annular opening $A_B$ is sized to receive the casing annular wall portion 5 with minimal clearance, which assists in sealing the casing opening $O_c$.

Figure 6:
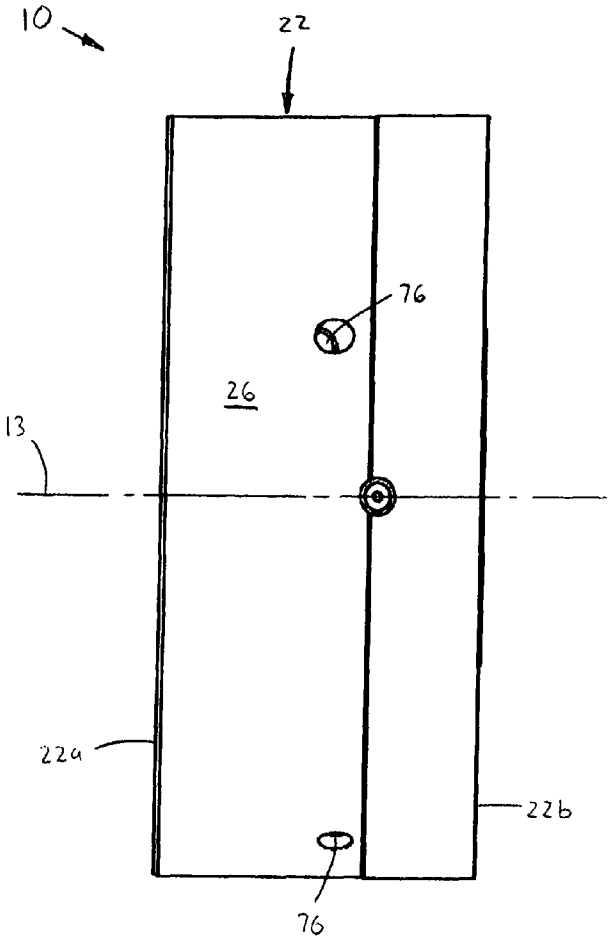
FIG. 6 is side plan view of the first embodiment closure device.
Figure 9:
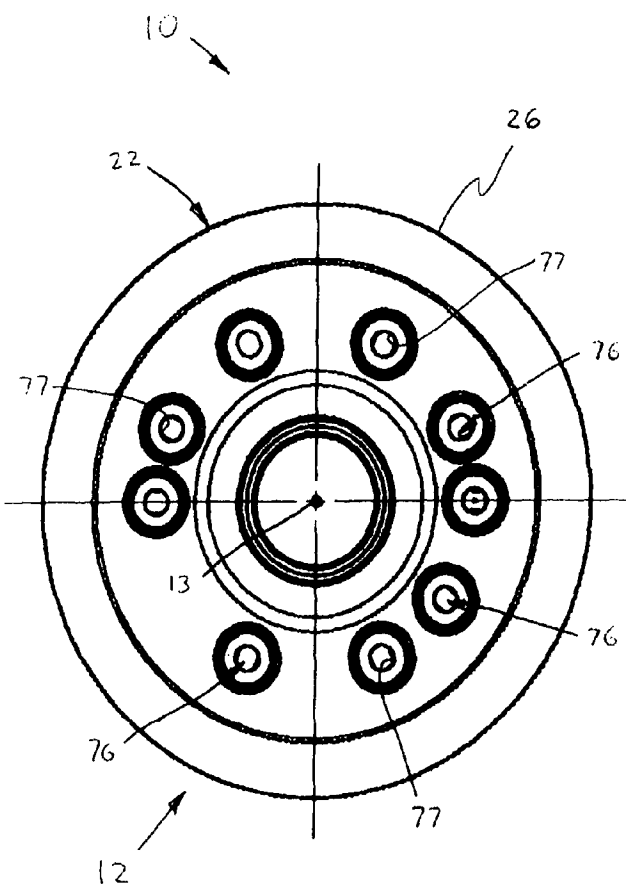
FIG. 9 is a rear plan view of the first embodiment closure device.
Figure 8:
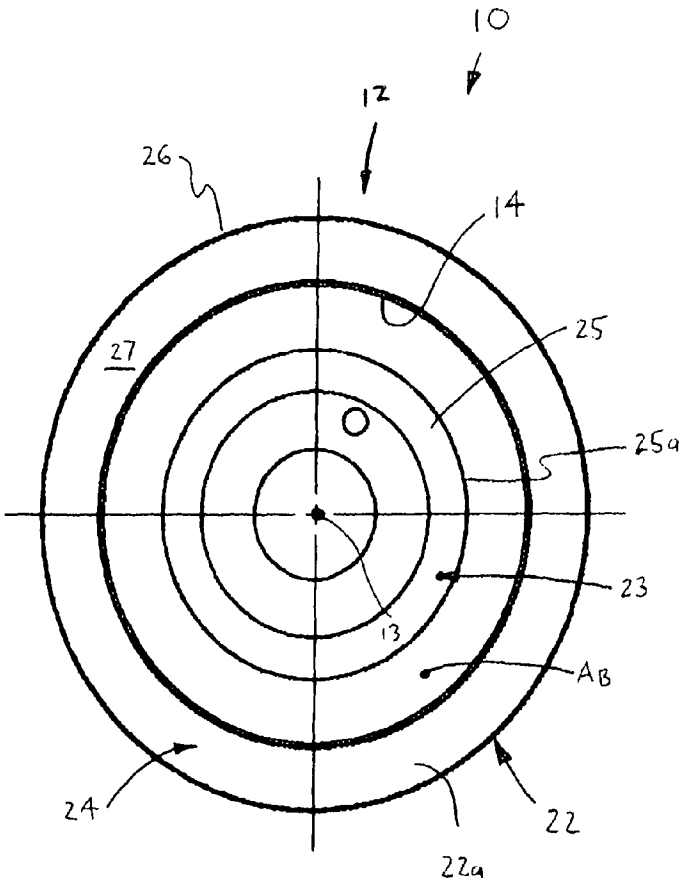
FIG. 8 is a front plan view of the first embodiment closure device.

Referring to FIGS. 6, 7 and 9, the closure body 22 of the first embodiment preferably further includes a plurality of fluid passages 76 configured to direct fluid toward and/or away from the grooves 71 for use with the sealing assembly components (not depicted). Each fluid passage 76 preferably extends axially inwardly from a port 77 at the body rear axial end 22*b* and a generally radially to a port 78 extending through a separate seal groove 71.

Referring now to FIGS. 10-14, as discussed above, the second embodiment closure body 33 preferably includes a generally cylindrical inner portion 34 and a generally annular outer portion 36 spaced therefrom so as to define the preferred annular body opening $A_B$. Preferably, a generally radially-extending connective portion 39 extends between and integrally connects the inner and outer body portions 34, 36, respectively, and provides a radial contact surface 39*a*. The radial contact surface 39*a* is disposeable generally against the radial stop surface 5*a* of the casing annular wall section 5, such that the contact between the two radial surfaces 5*a*, 39*a*axially locates the closure body 12 with respect to the casing 3. Further, when used to seal an inlet end 3*a* of the casing 3, the closure body cylindrical portion 34 preferably has a generally radially extending surface 34*a* configured or contoured to partially define a portion of the compressor fluid inlet chamber 68, as best shown in FIG. 10.

Furthermore, the outer circumferential surface 35 of the closure body cylindrical portion 34 is preferably sized to fit "closely" within and against the casing inner circumferential surface 7 so as to substantially eliminate clearance space between the body inner portion 34 and the casing 3. That is, the casing inner surface 7 preferably has an inside diameter $ID_1$ that is slightly greater than the closure body surface outside diameter $OD_1$, as indicated in FIG. 18. Furthermore the closure body annular portion 36 is sized to fit closely about the casing annular wall portion 5 with minimal clearance; in other words, the closure overlap surface 14 has an inside diameter $ID_2$ that is only slightly greater than outside diameter $OD_2$ of the casing wall outer surface 6. Thus, the closure body annular opening AB is sized to receive the casing annular wall portion 5 with minimal clearance, which assists in sealing the casing opening $O_C$.

Figure 12:
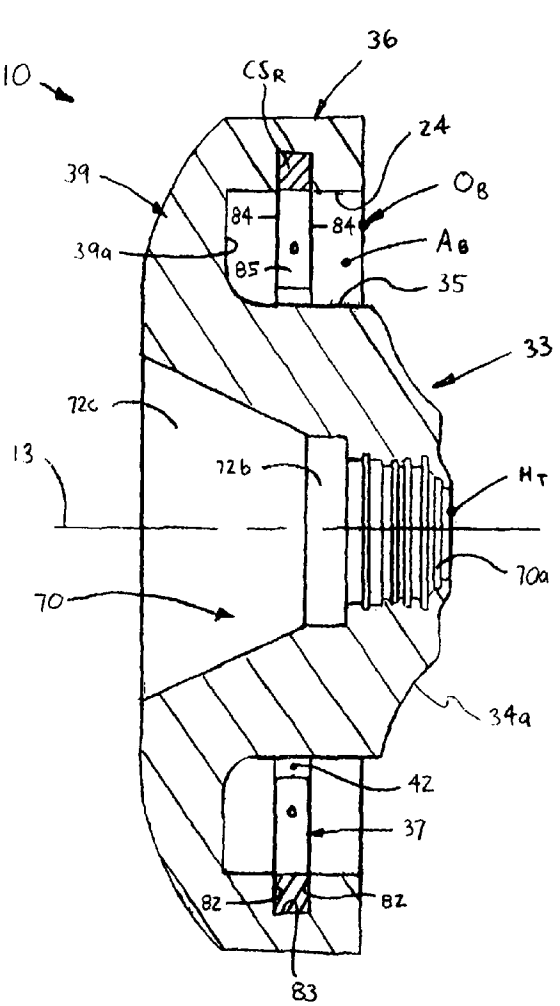
FIG. 12 is an axial cross-sectional view of the closure device of FIG. 11.
Figure 11:
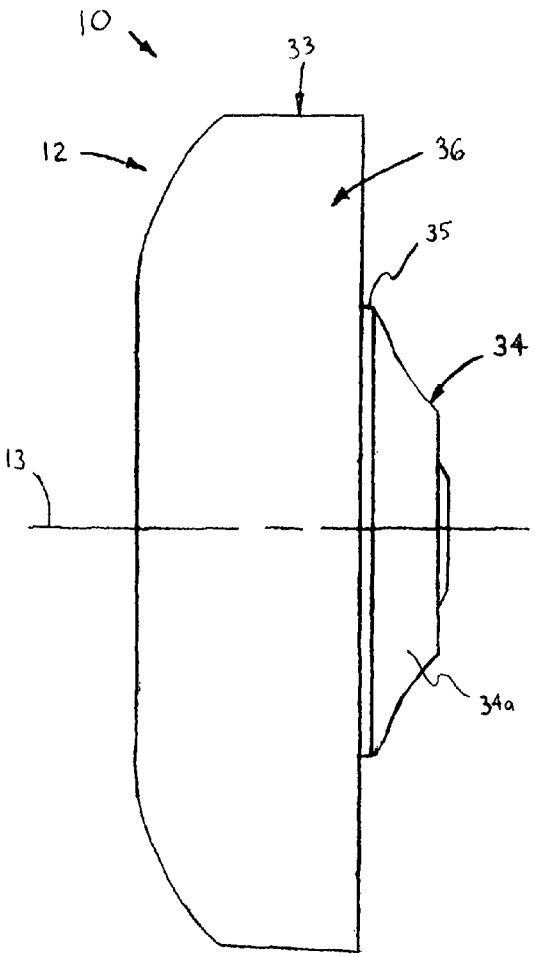
FIG. 11 is side plan view of one second embodiment closure device.
Figure 14:
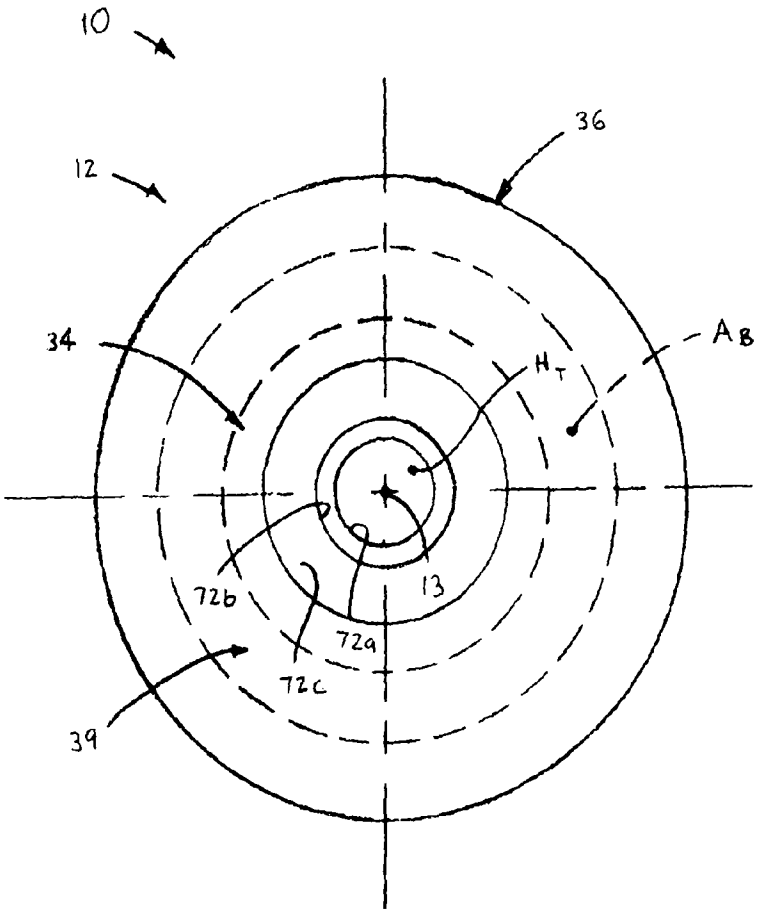
FIG. 14 is a rear plan view of the closure device.
Figure 13:
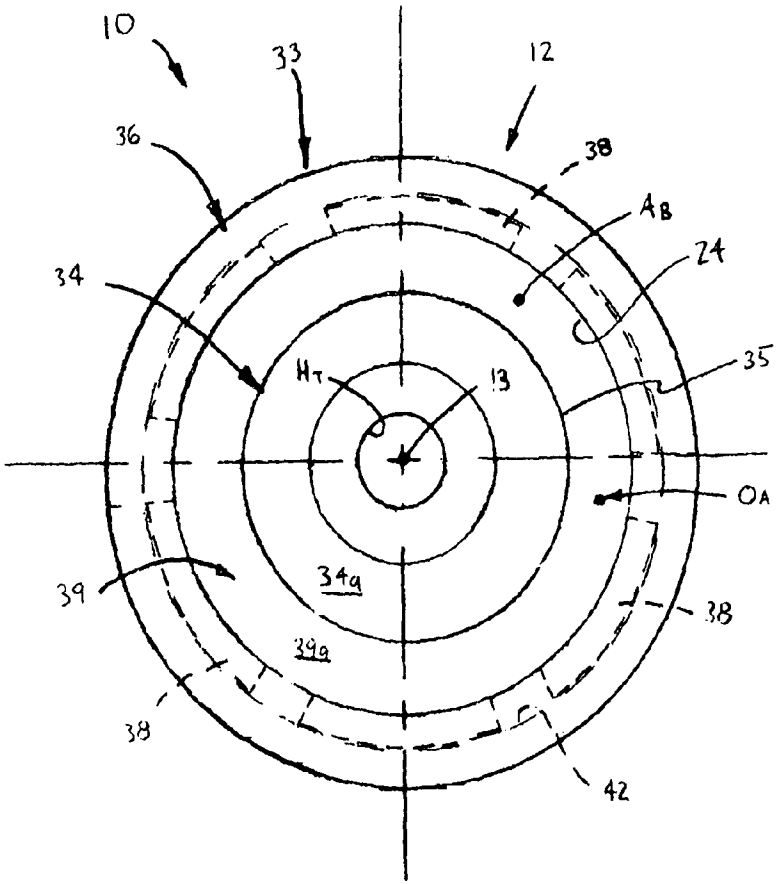
FIG. 13 is a front plan view of the closure device.

Referring now to FIGS. 10, 12 and 18, the casing circumferential groove 40 and the closure body circumferential groove 42 are each preferably defined by a pair of facing, substantially radial side surfaces 80, 82, respectively, and a circumferential surface 81, 83, respectively. Each circumferential surface 81, 83 extends between the associated pair of radial surfaces 80, 82, respectively, and generally faces the other circumferential groove surface 83, 81 when the closure device 10 is installed on the casing 3. Each retainer body 38 preferably has generally rectangular axial cross-sections $CS_R$ and includes a pair of opposing, substantially radial side surfaces 84 and an inner circumferential contact surface 85 extending between the side surfaces 84. As such, when each retainer 37 is advanced into the casing groove 40, the retainer side surfaces 84 slide generally against the casing groove side surfaces 80 until the retainer contact surface 84 contacts or "bottoms out" against the casing groove circumferential "stop" surface 81.

Alternatively, as shown in FIG. 16, the casing groove 40 may be formed with a pair of generally outwardly facing radial surfaces 86 which generally converge in a radial inward direction (i.e., toward the casing axis 4). Further, each retainer 37 may be formed with a pair of generally inwardly facing, opposing radial contact surfaces 87, which generally converge in a radial inward direction (i.e., toward the closure body centerline 13). As such, when each retainer 37 is advanced into the casing groove 40, the retainer angled surfaces 87 each generally wedge against one of the casing groove angled surfaces 86.

In either case, by locating the retainers 37 about a groove 40 that extends into the outer surface 6 of the casing 3, as opposed to the casing inner surface 7, the second embodiment closure device 10 has a much greater contact area for resisting axial forces exerted on the closure body 12 compared with previous closure devices. As such, the closure device 10 of the second embodiment is much more reliable for high-pressure compressor operation in comparison with prior art closure devices.

Figure 17:
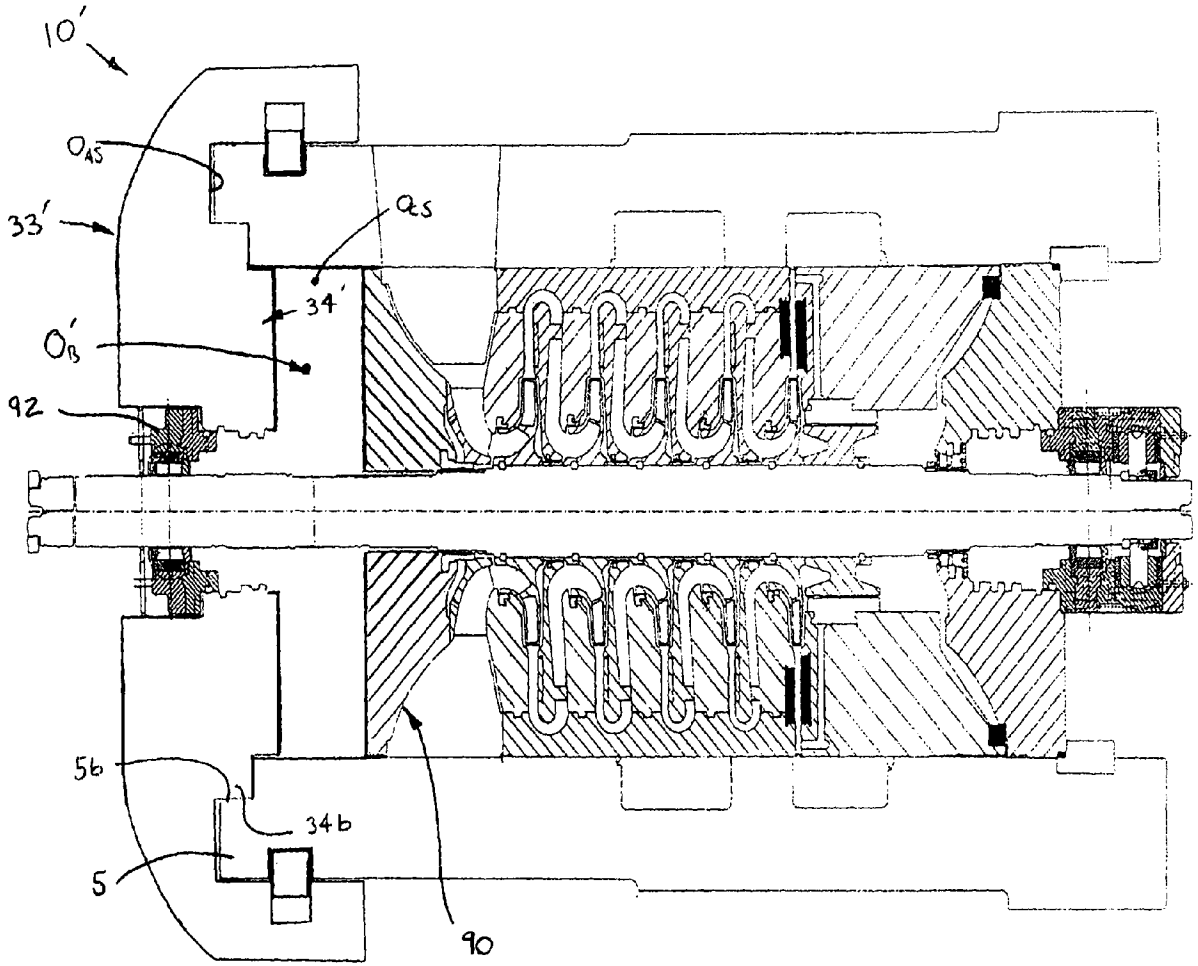
FIG. 17 is an axial cross-sectional view of a turbomachine having an alternative construction of the second embodiment closure device.

Referring to now to FIG. 17, in an alternative construction of the second embodiment of the closure device 10, the closure body 33' is formed with an inner cylindrical portion 34' that has much lesser axial length than the cylindrical portion 34 depicted in FIGS. 10-16. Such a body construction requires less material to fabricate the closure body 33' as compared with the body 33, but the compressor 2 should be further provided with a generally cylindrical insert 90 to define or bound a section of the compressor fluid inlet chamber 68. Furthermore, the body opening $O_B'$ includes an outer, generally circular section $O_{CS}$ and an inner, annular section $O_{AS}$, the casing annular portion 5 extending through the opening circular section $O_{CS}$ and into the opening annular section $O_{AS}$. Further, the closure body 33' has a body inner cylindrical portion 34' that preferably includes a radial stepped portion 34*a* that mates with a counterbore hole 5*b* at the casing annular wall portion radial end 5*a*', which provides additional material to support for a shaft bearing 92. Otherwise, the alternative closure device 10' is generally similar to the second embodiment closure device 10 as described above.

Figure 4:
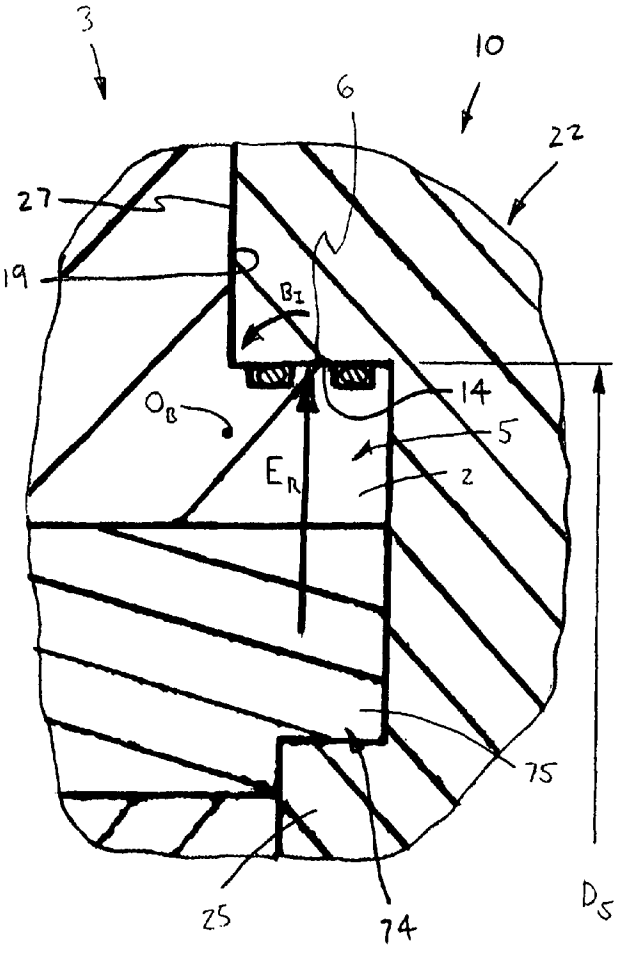
FIG. 4 is a greatly enlarged view of section 4 indicated in FIG. 3.

Referring to FIGS. 2-4, to install the first embodiment closure device 10, the closure body 22 is inserted axially through one casing end 3*a* or 3*b* until the body annular wall section 24 is disposed within the casing annular gap 21 and the casing annular ledge 20 is disposed in the closure body pocket 23. When the body 22 is so located, the seal member(s) 50 concurrently seal respectively against the closure body overlap surface 14. The plurality of first retainer segments 30*a* are then assembled within the casing groove 29 so as to be disposed against the body second end 22*b* and are spaced circumferentially about the casing axis 4 until the first, sheer ring 30 is formed. Next, the second retainer segments 31 a are assembled in the groove 29 so as to be spaced circumferentially about the axis 4, which form the second, or retainer ring 31 and occupy the groove space remaining after assembly of the shear ring 30. The closure device 10 is then arranged to seal the casing opening $O_C$ during compressor operation, the sealing function being enhanced by casing radial expansion while the closure device 10 simultaneously acts to reduce such casing expansion or "dilation". To remove the closure device 10, the arcuate segments 31*a*, 30*a* are removed in reverse order, and then body 22 is slided axially out of the casing 3.

Referring now to FIGS. 10 and 18, with the second embodiment closure device, the closure device body 33 is first positioned adjacent to one end 3*a* or 3*b* of the casing 3, and then is advanced axially along the shaft 8 toward the casing center (not indicated) such that the body cylindrical portion 26 enters the casing opening $O_C$ and the shaft end 20*a* or 8*a* is inserted into the through hole $H_T$, and then the casing annular wall portion 5 enters the closure body annular opening $A_B$. When the casing end surface 16*a* is abutted against the body radial surface 29*a*, the closure device 10 is axially located to enable assembly of the retainers 37 into the casing groove 40, the seal member(s) 50 or 51 concurrently sealing respectively against the closure body overlap surface 14 or about the casing outer surface 6. Each positioner rod 46 is then rotated in the first direction until the contact surface 85 of the associated retainer 37 bottoms against the casing groove stop surface 35, as best shown in FIG. 2, or until the associated angled surface pairs 86/87 wedge against each other as depicted in FIG. 16. As with the first embodiment, the second embodiment closure device 10 is then arranged to close or seal the casing opening $O_C$ during compressor operation, such closing/sealing function being enhanced by casing radial expansion as the closure device 10 simultaneously acts to reduce such casing expansion. To remove the closure device 10, the positioner rods 46 are rotated in the second direction until each retainer is completely withdrawn into the closure body groove 42, and then the closure body 12 may be displaced axially outwardly from the casing center until the body cylindrical portion 26 is completely removed from the casing chamber $C_C$.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined generally in the appended claims.

We claim:

1. A turbomachine comprising:

a casing having an interior chamber, an opening into the interior chamber, and an annular wall section extending about the opening and having an outer circumferential surface, the casing having opposing axial ends and a central bore extending between the two ends, the casing bore providing the casing chamber; and a closure device engageable with the casing and including a body having an inner circumferential overlap surface at least partially defining an opening, the closure body being configured to receive at least a portion of the casing annular wall section within the body opening such that the closure body overlap surface extends about the annular wall section outer surface and the closure device substantially closes the casing opening, the closure device body including a cylindrical body with a centerline and an integral annular ledge extending circumferentially about the axis, the body ledge having an inner circumferential providing the overlap surface, the closure device body being sized to be disposeable within a portion of the casing bore such that the entire closure body is located between the first and second casing ends.

2. The turbomachine as recited in claim 1 wherein the closure device body has first and second axial ends, the body first end being spaced axially from the casing first end in a direction toward the casing second end, and the body second end being spaced axially from the casing second end in a direction generally toward the casing first end.

3. A turbomachine comprising:

a casing having an interior chamber, an opening into the interior chamber, and an annular wall section extending about the opening and having an outer circumferential surface, the casing having a shoulder surface, a first inner circumferential surface with a first diameter, a second inner circumferential surface with a second diameter, the second diameter being substantially larger than the first diameter, a radial surface extending between the first and second circumferential surfaces, and an annular ledge extending generally axially from the shoulder surface and circumferentially about the casing axis, the annular ledge providing the casing annular wall section and outer circumferential surface; and a closure device engageable with the casing and including a body having an inner circumferential overlap surface at least partially defining an opening, the closure body being configured to receive at least a portion of the casing annular wall section within the body opening such that the closure body overlap surface extends about the annular wall section outer surface and the closure device substantially closes the casing opening, the closure device body including a circular cylindrical body with a centerline and an integral annular ledge extending circumferentially about the axis, the body ledge having an inner circumferential providing the overlap surface, the closure device body further having an outer circumferential surface, the closure body annular ledge having a radial shoulder surface, and the closure body being configured to receive at least a portion of the casing ledge such that the body annular ledge extends coaxially about the casing ledge, the body outer circumferential surface is disposeable against the casing second inner circumferential surface, and the closure ledge radial surface is disposed at least adjacent to the casing radial surface.

4. The turbomachine as recited in claim 3 wherein a generally annular gap is defined between the ledge outer circumferential surface and the casing second inner circumferential surface, the annular gap being sized to receive at least a portion of the closure body annular ledge.

5. The turbomachine as recited in claim 4 wherein the closure device body has opposing axial ends and an outer circumferential surface extending axially between the two ends, the body outer circumferential surface being disposed generally against the casing second inner circumferential surface when the closure device is engaged with the casing.

6. The turbomachine as recited in claim 3 wherein the closure device further includes at least one retainer engageable with the casing and configured to retain the closure body coupled with the casing.

7. A turbomachine comprising:

a casing having an interior chamber, an opening into the interior chamber, and an annular wall section extending about the opening and having an outer circumferential surface, the casing having an inner circumferential surface and an annular groove extending radially outwardly from the inner surface;

a closure device engageable with the casing and including a body having an inner circumferential overlap surface at least partially defining an opening, the closure body being configured to receive at least a portion of the casing annular wall section within the body opening such that the closure body overlap surface extends about the annular wall section outer surface and the closure device substantially closes the casing opening, the closure device body including a cylindrical body with a centerline and an integral annular ledge extending circumferentially about the axis, the body ledge having an inner circumferential providing the overlap surface, the closure device further including at least one retainer engageable with the casing and configured to retain the closure body coupled with the casing, the closure body being disposed at least partially within the casing inner circumferential surface; and the retainer being at least partially disposeable within the casing groove and against the closure body so as to substantially prevent displacement of the closure body along the casing axis.

8. The turbomachine as recited in claim 7 wherein the retainer includes a plurality of arcuate segments spaced circumferentially about the casing axis.

9. The turbomachine as recited in claim 3 further comprising a rotatable shaft and wherein the closure device cylindrical body includes a central through hole configured to receive a portion of the shaft.

10. The turbomachine as recited in claim 9 wherein the closure device is configured to seal about the shaft portion so as to prevent fluid flow through the closure body through hole.

11. The turbomachine as recited in claim 3 wherein the closure device further comprises a generally annular seal ring disposed generally between the casing annular wall section outer surface and the closure device overlap surface and configured to substantially prevent fluid flow out of the casing chamber.

12. The turbomachine as recited in claim 9 wherein the casing includes at least one annular groove extending radially inwardly from the annular wall section outer surface, the seal ring being disposed within the casing annular groove and contactable with the closure body overlap surface.

13. A turbomachine comprising:

a casing having an interior chamber, an opening into the interior chamber, and an annular wall section extending about the opening and having an outer circumferential surface; and a closure device engageable with the casing and including a body having an inner circumferential overlap surface at least partially defining an opening, the closure body being configured to receive at least a portion of the casing annular wall section within the body opening such that the closure body overlap surface extends about the annular wall section outer surface and the closure device substantially closes the casing opening, wherein the closure body includes:

a cylindrical inner portion at least partially disposeable within the casing opening;

an annular outer portion having an inner surface providing the overlap surface and disposeable at least partially about the casing outer surface; and a radially extending connective portion extending between and integrally connecting the inner and outer body portions.

14. The turbomachine as recited in claim 13 wherein:

the casing has an inner circumferential surface at least partially defining the casing interior chamber; and the closure body inner portion has an outer circumferential surface sized to fit within the casing inner circumferential surface so as to substantially eliminate clearance space between the body inner portion and the casing.

15. The turbomachine as recited in claim 14 wherein the closure body inner portion has a generally radially extending surface configured to at least partially define a fluid inlet of the turbomachine.

* * * * *